US007862353B1

(12) United States Patent
Azad et al.

(10) Patent No.: US 7,862,353 B1
(45) Date of Patent: Jan. 4, 2011

(54) ELECTRICAL CONNECTOR HOUSING AND ELECTRICAL CONNECTOR ASSEMBLY INCORPORATING THE ELECTRICAL CONNECTOR HOUSING

(75) Inventors: Vikas Azad, Novi, MI (US); Makiko Kawamura, Ann Arbor, MI (US); Ping Chen, Novi, MI (US)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/820,441

(22) Filed: Jun. 22, 2010

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 5,435,738 A 7/1995 Isohata
5,463,912 A 11/1995 Inoue et al.
5,618,209 A 4/1997 Lin et al.
5,823,808 A 10/1998 Clark et al.
6,971,894 B2 * 12/2005 Dillon et al. ..... 439/157

* cited by examiner

*Primary Examiner*—Javaid Nasri
(74) *Attorney, Agent, or Firm*—Radar, Fishman & Grauer PLLC

(57) ABSTRACT

An electrical connector housing has a housing body and a U-shaped lever that is connected to the housing body in a manner that the U-shaped lever can both pivot and slide relative to the housing body. The U-shaped lever engages a mounting structure so that the U-shaped lever pivots from a pre-engaged position to an engaged, extended position in order to draw a female electrical terminal into secure connection with a male electrical terminal and, simultaneously therewith, the housing body is drawn into sealing contact with the mounting structure. From the engaged, extended position, the U-shaped lever slidably moves to an engaged, retracted position relative to the housing body. The electrical connector housing and the mounting structure constitute an electrical connector assembly.

26 Claims, 15 Drawing Sheets

ELECTRICAL CONNECTOR HOUSING AND ELECTRICAL CONNECTOR ASSEMBLY INCORPORATING THE ELECTRICAL CONNECTOR HOUSING

FIELD OF THE INVENTION

The present invention relates to an electrical connector housing and an electrical connector assembly that incorporates the same. More particularly, the present invention is directed to an electrical connector housing that employs a U-shaped lever to releasably engage the electrical connector housing to a mounting structure.

BACKGROUND OF THE INVENTION

Many types of electrical connectors that employ a lever are known in the art. For instance, U.S. Pat. No. 5,823,808 to Clark teaches a cam lever operated connector. This electrical connector includes a male member, a female member, a cam lever for engaging the male and female members and a lock portion. The lock portion includes a sliding member slidable on a track and engages the cam lever for holding the cam lever in a closed position.

U.S. Pat. No. 5,463,912 discloses a lever-operated connector. The lever-operated connector is connected together by using a lever. The lever has pins. The connector housing includes positioning notches for positioning the pins of the lever to insert, slanting guide surfaces arranged beneath the notches for elastically deforming the lever according to inserting the pins into the slanting guide surfaces and bearing holes arranged beneath the slanting guide surfaces for receiving and pivotally supporting the pins of the lever.

U.S. Pat. No. 5,435,738 reveals a lever-type connector that includes a plug subassembly and a cap housing. The plug subassembly has a cover housing, a plug housing and a lever. The cover housing has an opening for receiving the plug housing. The plug housing has cavities for receiving terminals therein. The lever is attachable to the cover housing and is adapted to move the plug housing relative to the cover housing. The cap housing receives contacts therein and has an opening for receiving the plug housing of the subassembly and being attachable to the cover housing. Operation of the lever moves the plug housing from an unterminated position to a terminated position.

SUMMARY OF THE INVENTION

One exemplary embodiment of an electrical connector housing of the present invention includes a housing body and a U-shaped lever. The housing body has a base wall, a front wall, a rear wall and a pair of side walls connected to each other to form a generally box-shaped configuration. The U-shaped lever is pivotably and slidably connected to the housing body on the pair of the side walls. The U-shaped lever has a pair of longitudinally-extending lever arms facially opposing and extending parallel to each other and a cross member interconnecting the pair of lever arms as an integral construction to form a U-shaped channel. Each one of the pair of lever arms has a lever arm inner surface facing interiorly into the U-shaped channel and a lever arm outer surface facing exteriorly of the U-shaped channel. Each one of the pair of lever arms has a longitudinally-extending slot formed into the lever arm inner surface and a guide rail projecting from the lever arm outer surface. The guide rail has a straight guide rail portion that is disposed offset from and extends parallel to the slot and an arcuate guide rail portion that is connected to the straight guide rail portion thereby forming the guide rail into a generally hook-shaped configuration.

Another exemplary embodiment of the present invention is an electrical connector assembly for connecting a female electrical terminal to a male electrical terminal. The male electrical terminal extends through a support surface hole of a support surface and is secured therein in a stationary manner. The electrical connector assembly includes the electrical connector housing described above and a mounting structure.

The mounting structure includes a flat mounting plate that defines a mounting plate plane. The flat mounting plate is formed with at least one mounting plate hole extending therethrough and a pair of fulcrum parts that are connected to and project from the flat mounting plate, are disposed apart from one another and straddle the at least one mounting plate hole. The mounting structure is fastened to the support surface in a manner that the at least one mounting plate hole and the support surface hole facially oppose and communicate with each other.

The housing body retains the female electrical terminal therein. The male electrical terminal projects through the support surface hole and the at least one mounting plate hole at a distance in order to be received by and connected to the female electrical terminal. When the electrical connector housing is placed over the mounting structure to cover the at least one mounting plate hole, the U-shaped lever is in a pre-engaged position. In the pre-engaged position, respective ones of the guide rails are aligned to engage respective ones of the fulcrum parts and the female electrical terminal and the male electrical terminal are aligned to engage with each other. When the respective ones of the guide rails engage the respective ones of the fulcrum parts, the U-shaped lever is operative to angularly move from the pre-engaged position to an engaged, extended position so that the housing body is drawn towards and is connected to the mounting structure and the female electrical terminal is drawn towards and is electrically connected to the male electrical terminal. In the engaged, extended position, the slot is oriented parallel to the mounting plate plane with the cross member being disposed apart from the front wall of the housing body. Furthermore, the U-shaped lever is operative in the engaged, extended position to move rectilinearly to an engaged, retracted position so that the cross member is disposed adjacent the front wall of the housing body.

The present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to respective embodiments of the present invention will be represented by the same symbols and repeated description thereof will be omitted.

Figure 1:
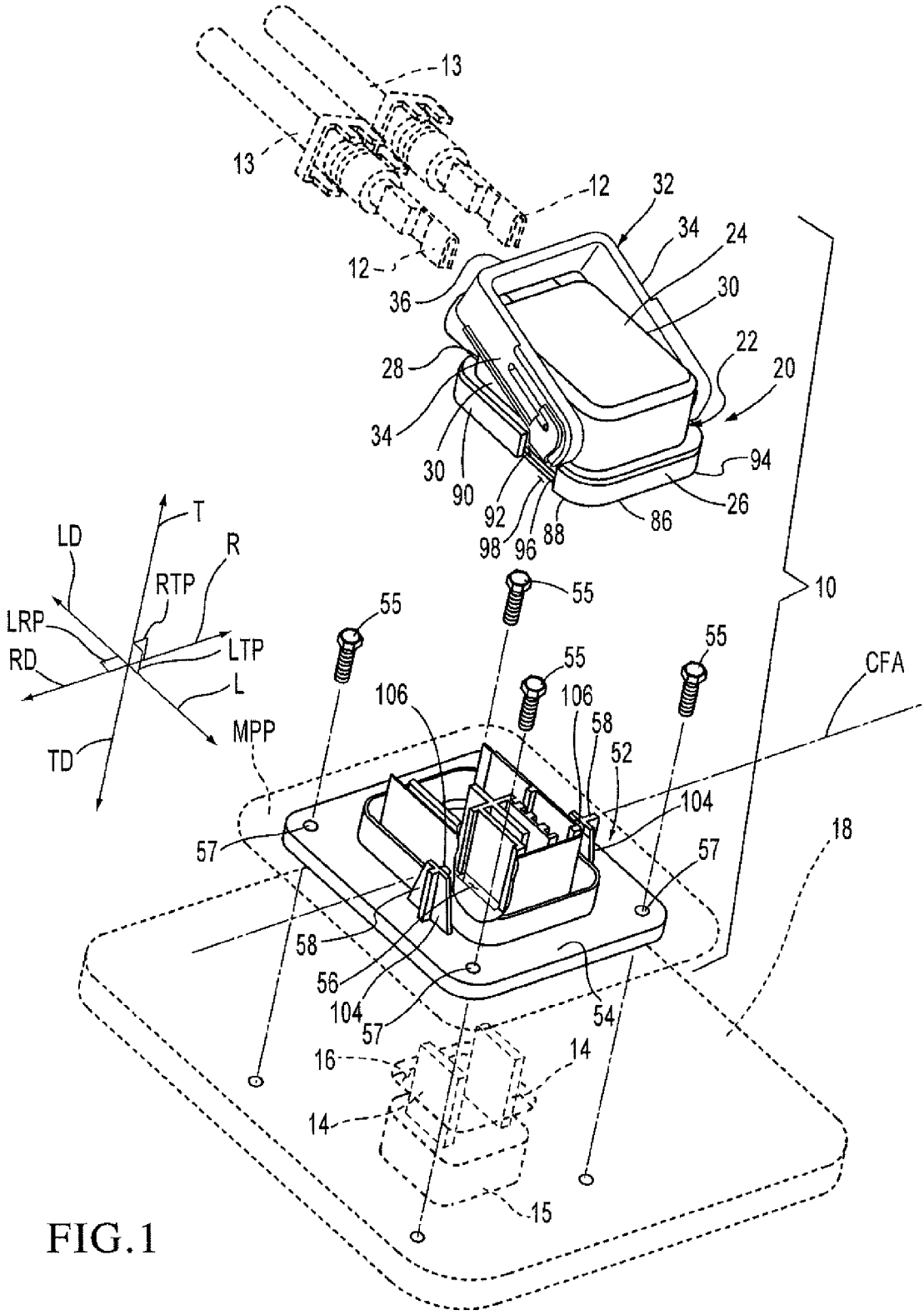
FIG. 1 is an exploded perspective view of an exemplary embodiment of an electrical connector assembly of the present invention illustrated with an exemplary embodiment of an electrical connector housing of the present invention disposed above a mounting structure which in turn is disposed above a conventional support surface.
Figure 2:
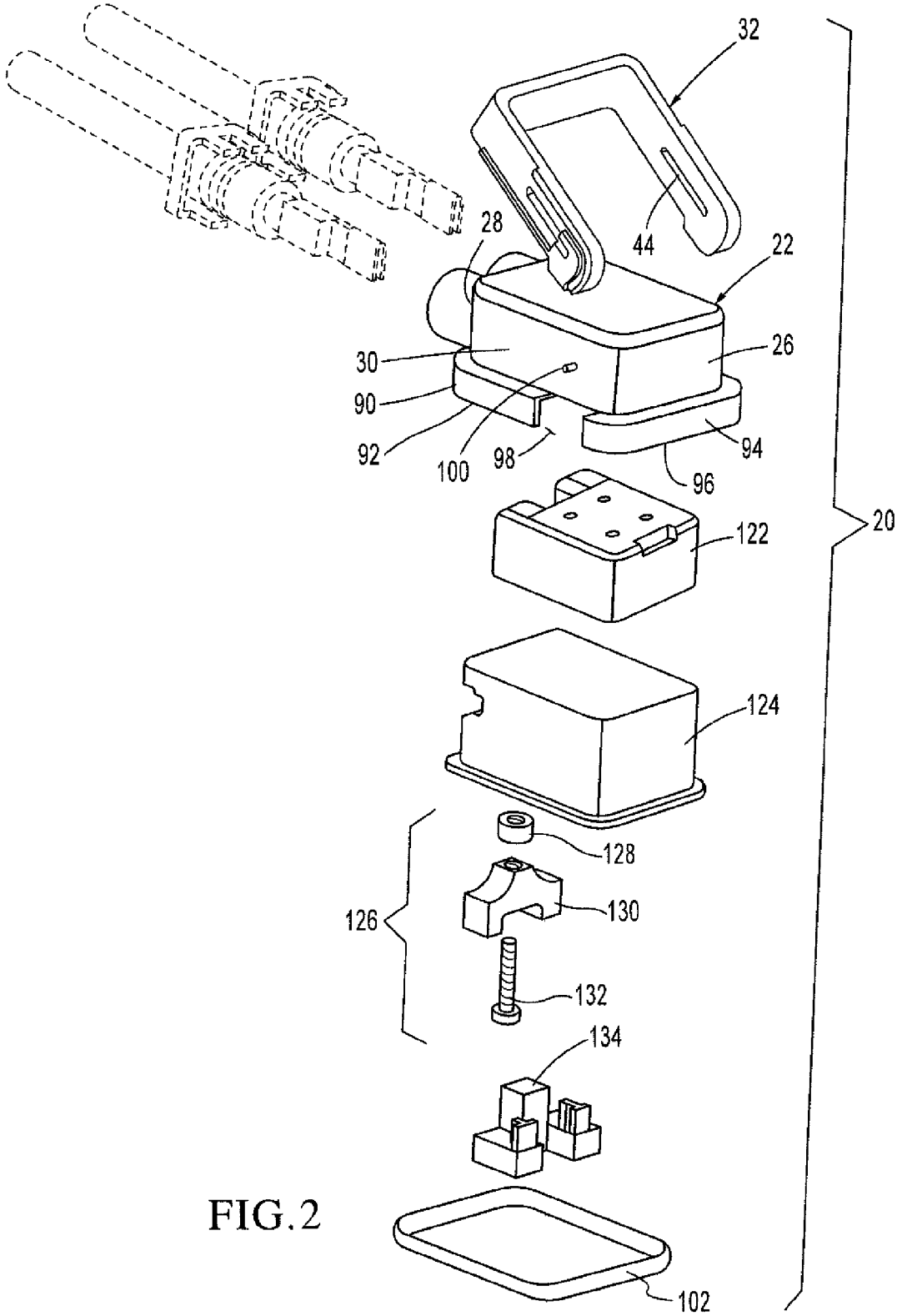
FIG. 2 is an exploded perspective view of the electrical connector housing of the present invention having a housing body and a U-shaped lever illustrated with operating components that are to be secured inside the housing body.

As shown in FIGS. 1-3, an electrical connector assembly 10 of an exemplary embodiment of the present invention connects a pair of female electrical terminals 12 connected to respective ones of a pair of cable assemblies 13 to respective ones of a pair of male electrical terminals 14 connected to a power supply 15. One of ordinary skill in the art would appreciate that the electrical connector assembly 10 could, if desired, connect a single female electrical terminal 12 to a single male electrical terminal 14. In FIG. 1, a pair of the male electrical terminals 14 extend through a support surface hole 16 of a support surface 18. The pair of male electrical terminals 14 are secured in and project through the support surface hole 16 in a fixed, stationary manner.

With reference to FIGS. 1-3, the electrical connector assembly 10 of the present invention includes an electrical connector housing 20 and a mounting structure 52. The electrical connector housing 20 includes a housing body 22 and a U-shaped lever 32. The housing body 22 has a base wall 24, a front wall 26, a rear wall 28, a pair of side walls 30 connected to each other to form a generally box-shaped configuration. One skilled in the art would appreciate that the housing body 22 extends along and about a longitudinal axis L in a longitudinal direction LD, a transverse axis T in a transverse direction TD and a lateral axis R in a lateral direction RD and that longitudinal axis L, the transverse axis T and the lateral axis R intersect one another perpendicularly at a common point CP that constitutes a conventional Cartesian coordinate system. As commonly known in the art, the longitudinal axis L and the transverse axis T form a longitudinal/transverse plane LTP, the longitudinal axis L and the lateral axis R form a longitudinal/lateral plane LRP and the lateral axis R and the transverse axis T form a lateral/transverse plane RTP.

Figure 8:
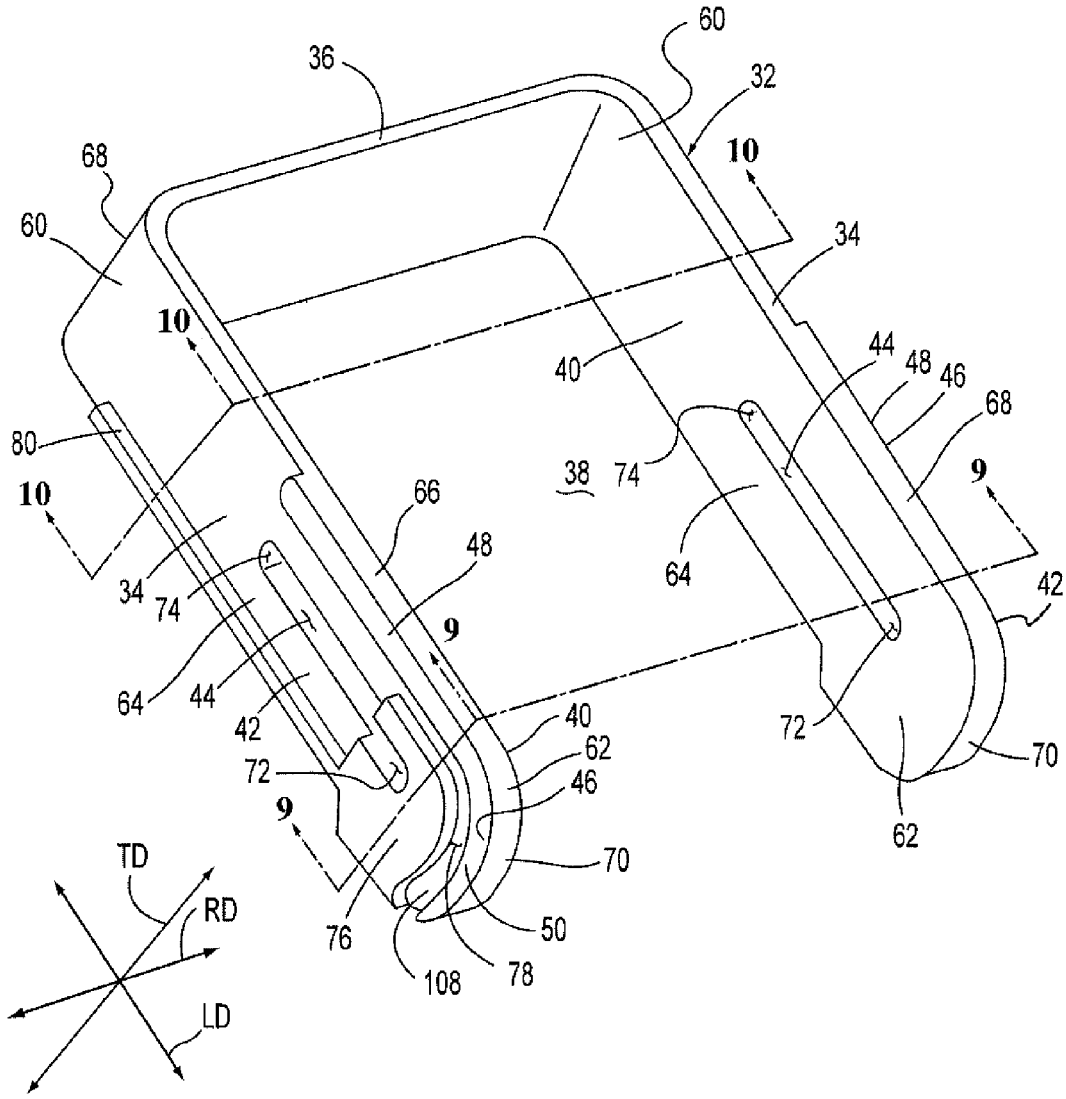
FIG. 8 is a perspective view of the U-shaped lever.

As shown in FIGS. 1 and 4A-7C, the U-shaped lever 32 is pivotably and slidably connected to the housing body 22 on the pair of the side walls 30. The U-shaped lever 32 has a pair of lever arms 34 extending in a generally longitudinal lengthwise direction that facially oppose and extend parallel to each other. As best illustrated in FIG. 8, the U-shaped lever 32 also has a cross member 36 that interconnects the pair of lever arms 34 as an integral construction to form a U-shaped channel 38. Each one of the pair of lever arms 34 having a lever arm inner surface 40 facing interiorly into the U-shaped channel 38 and a lever arm outer surface 42 facing exteriorly of the U-shaped channel 38. Each one of the pair of lever arms 34 has a slot 44 extending the generally longitudinally lengthwise direction formed into the lever arm inner surface 40. Although not by way of limitation but by example only, respective ones of the slots 44 extend completely through respective ones of the lever arms 34 as illustrated in FIG. 8. Also, each one of the pair of lever arms 34 has a guide rail 46 that projects from the lever arm outer surface 42. The guide rail 46 has a straight guide rail portion 48 that is disposed offset from and extends parallel to the slot 44 and an arcuate guide rail portion 50 that is connected to the straight guide rail portion 48 thereby forming the guide rail 46 into a generally hook-shaped configuration as shown in FIG. 8.

In FIGS. 1 and 3, the mounting structure 52 includes a flat mounting plate 54 defining a mounting plate plane MPP. Additionally, the mounting structure 52 is formed with a pair of mounting plate holes to accommodate the two male electrical terminals 14, although only one mounting plate hole is illustrated in FIG. 1. A skilled artisan would appreciate that there must be one mounting plate hole 56 to accommodate one male electrical terminal 14 and thus there must be one mounting plate hole 56 for each corresponding one of the male electrical terminals 14. The mounting plate holes 56 extend through the flat mounting plate 54. The mounting structure 52 also includes a pair of fulcrum parts 58 that connected to and project from the flat mounting plate 54. The pair of fulcrum parts 58 is disposed apart from one another and straddle the mounting plate holes 56 as best shown in FIG. 1. The mounting structure 52 is fastened to the support surface 18 by conventional fasteners 55 such as conventional bolts or screws through the fastening holes 57. In this manner, the mounting plate holes 56 and the support surface hole 16 facially oppose and communication with each other so that the pair of male electrical terminals 14 can extend therethrough.

As best shown in FIGS. 4C, 5C, 6C and 7C, the housing body 22 retains the female electrical terminals 12 therein while the male electrical terminals 14 project through the support surface hole 16 and the mounting plate holes 56 at a distance in order to be received by and connect to the female electrical terminals 12 as discussed in more detail below.

Figure 5A:
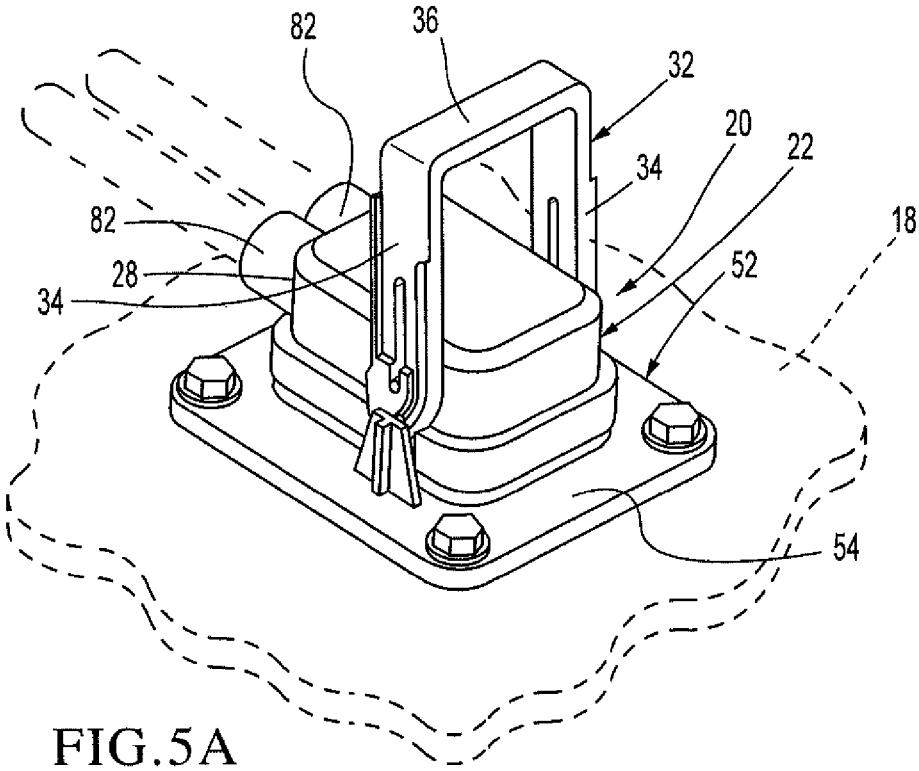
FIG. 5A is a perspective view illustrating the mounting structure and the convention support surface securely fastened together by conventional fasteners and the housing body placed over the mounting structure with the U-shaped lever being in an intermediate position.
Figure 5B:
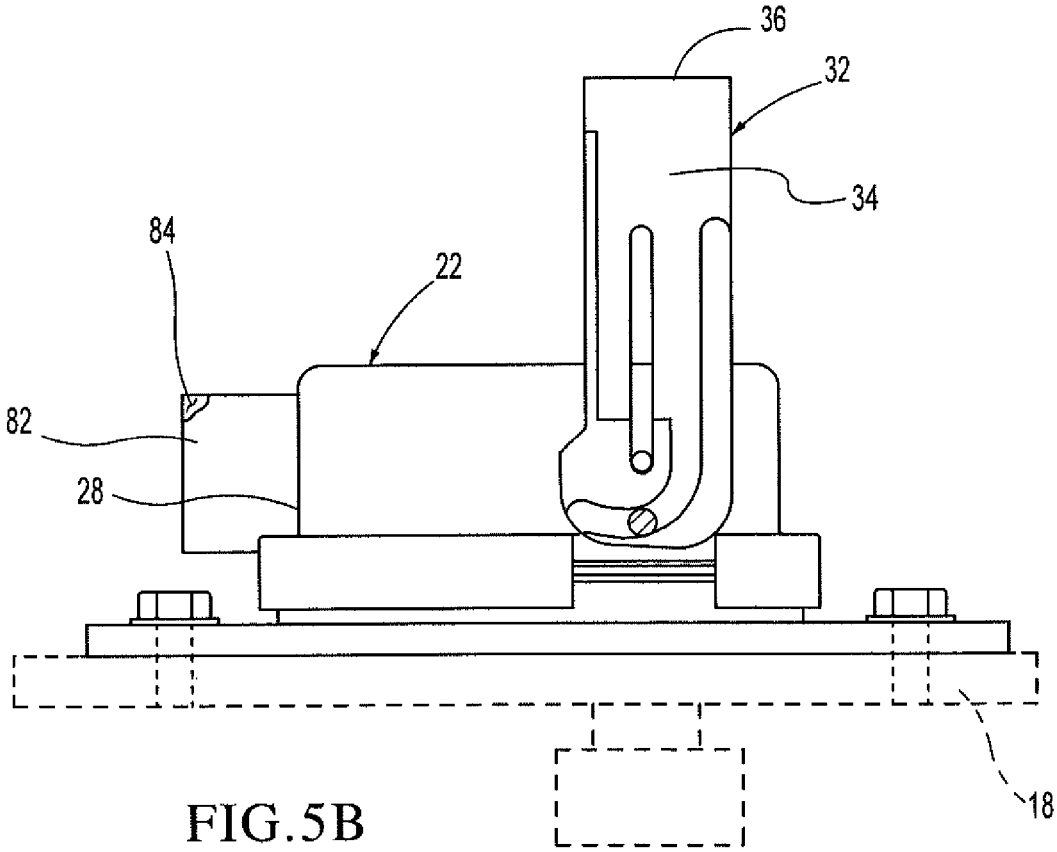
FIG. 5B is a side elevation diagrammatical view illustrating the mounting structure and the convention support surface securely fastened together by the conventional fasteners and the housing body placed over the mounting structure with the U-shaped lever being in the intermediate position and with a fulcrum pin of the mounting structure shown in cross-section.
Figure 5C:
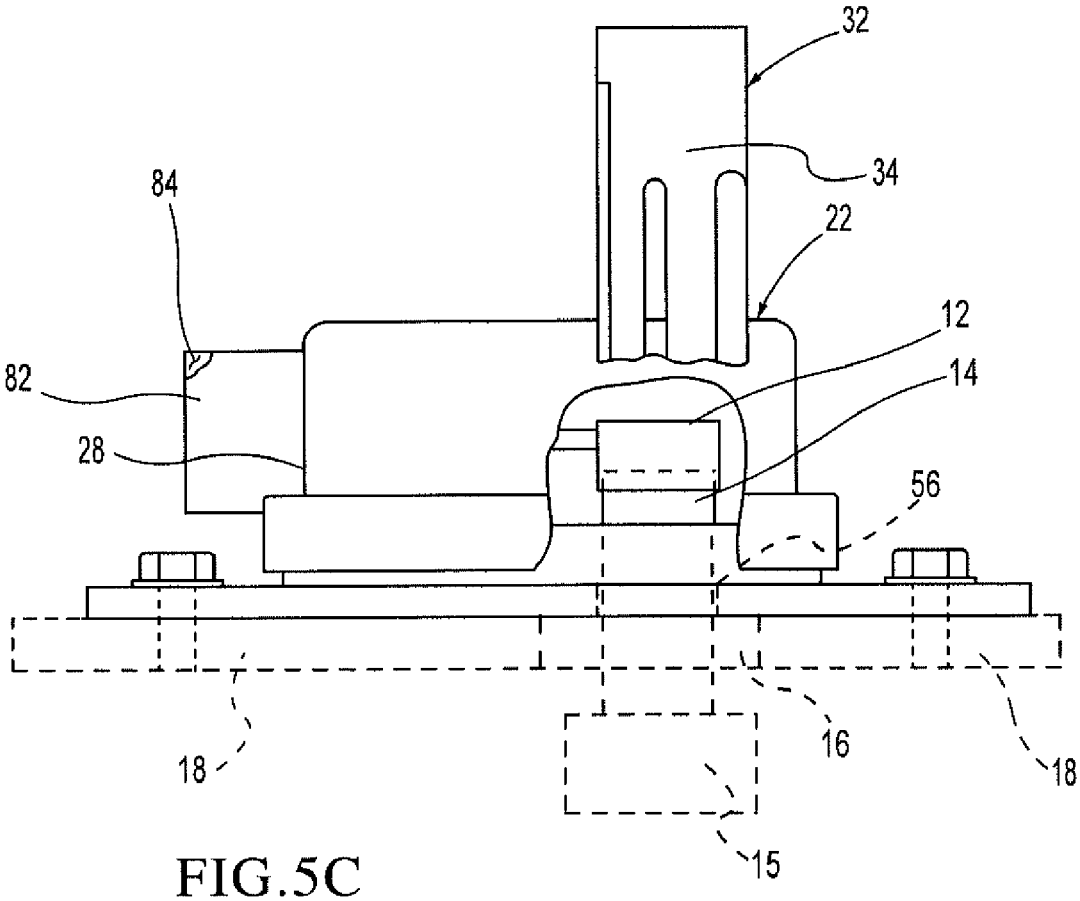
FIG. 5C is a side elevation diagrammatical view illustrating the mounting structure and the convention support surface securely fastened together by the conventional fasteners and the housing body contacting the mounting structure with the U-shaped lever being in the intermediate position with the female electrical terminal being partially drawn downwardly on the male electrical terminal and the housing body being partially drawn downwardly onto the mounting structure by angular movement of the U-shaped lever.
Figure 6A:
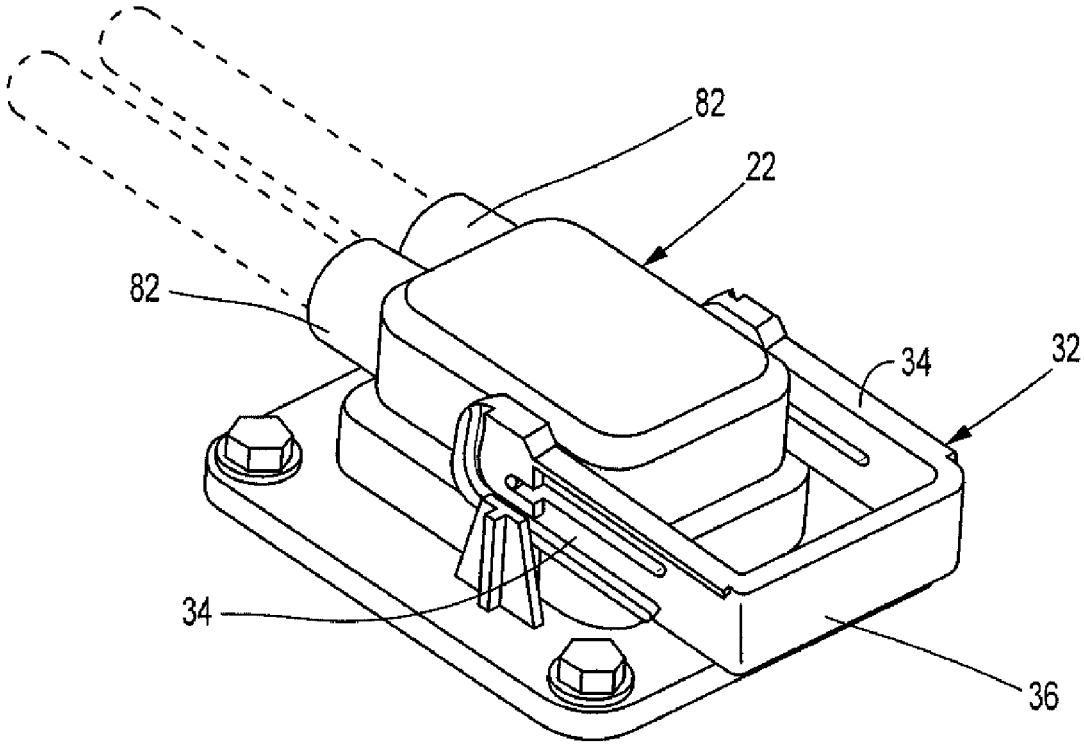
FIG. 6A is a perspective view illustrating the mounting structure and the convention support surface securely fastened together by conventional fasteners and the housing body contacting the mounting structure with the U-shaped lever being in an engaged, extended position.
Figure 6B:
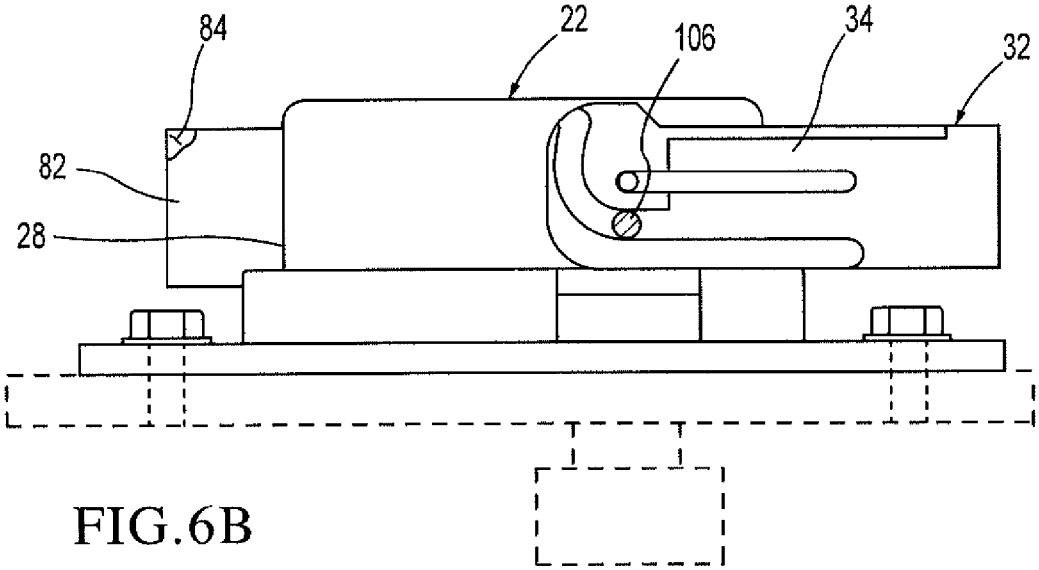
FIG. 6B is a side elevation diagrammatical view illustrating the mounting structure and the convention support surface securely fastened together by the conventional fasteners and the housing body contacting the mounting structure with the U-shaped lever being in the engaged, extended position and with the fulcrum pin of the mounting structure shown in cross-section.
Figure 6C:
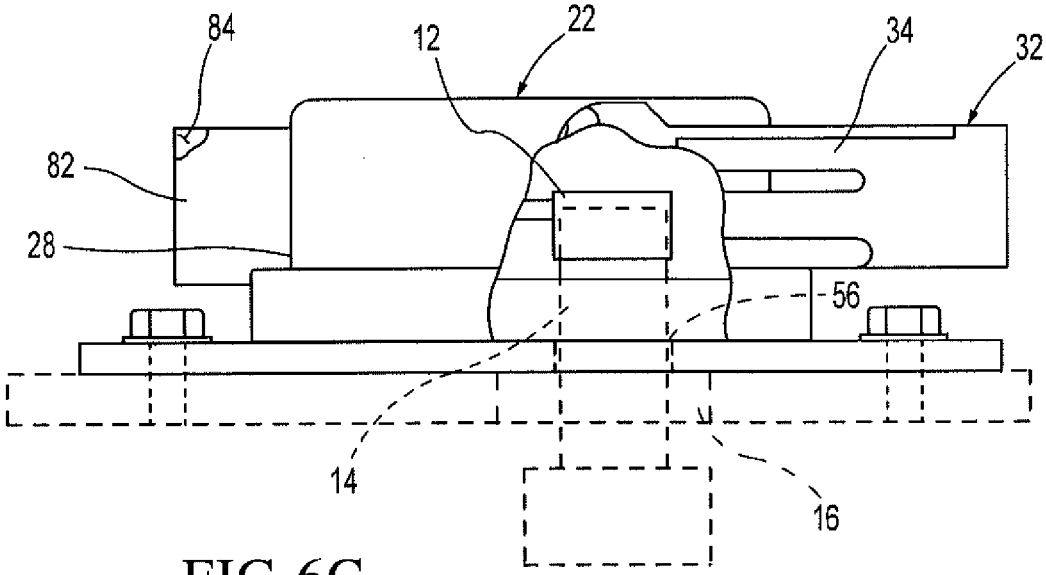
FIG. 6C is a side elevation diagrammatical view illustrating the mounting structure and the convention support surface securely fastened together by the conventional fasteners and the housing body contacting the mounting structure with the U-shaped lever being in the engaged, extended position with the female electrical terminal being fully drawn downwardly on the male electrical terminal and the housing body being fully drawn downwardly onto the mounting structure by further angular movement of the U-shaped lever.
Figure 7A:
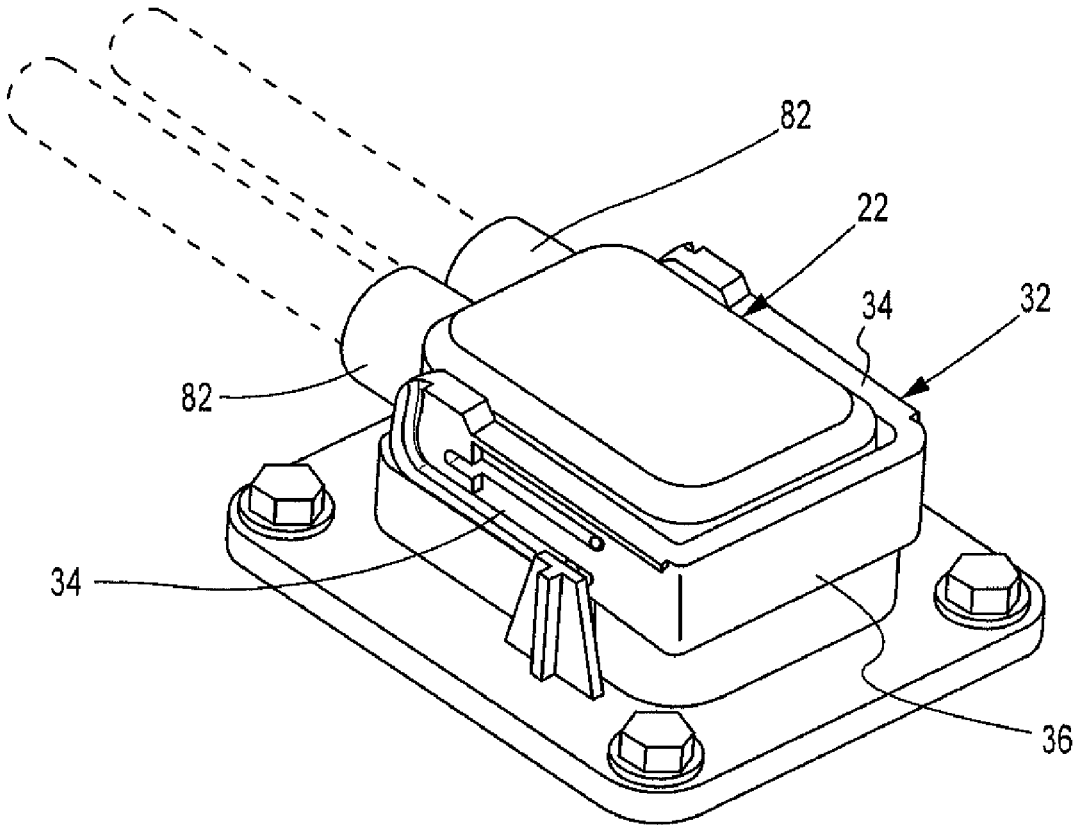
FIG. 7A is a perspective view illustrating the mounting structure and the convention support surface securely fastened together by conventional fasteners and the housing body contacting the mounting structure with the U-shaped lever being in an engaged, retracted position.
Figure 7B:
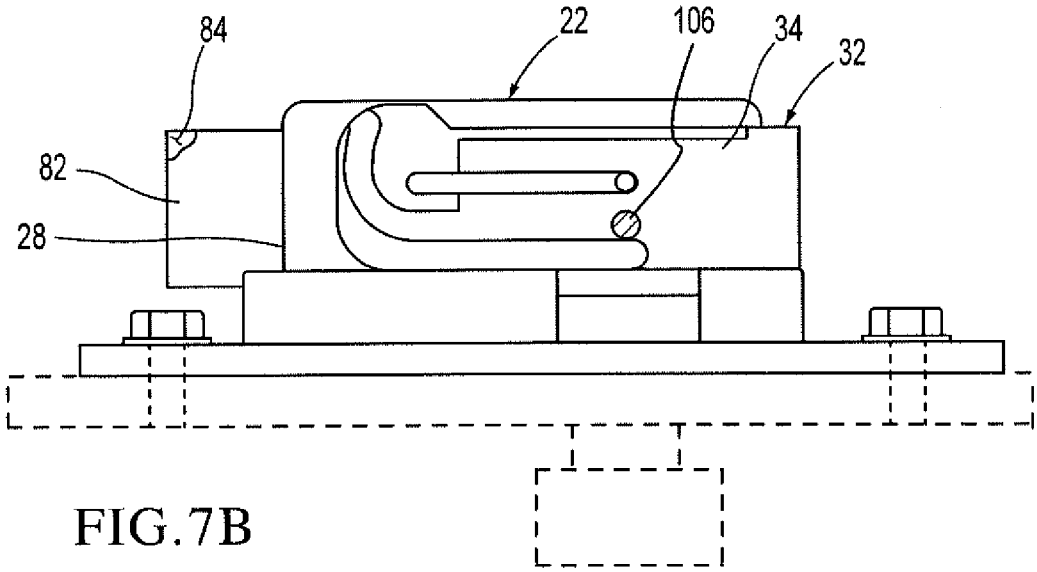
FIG. 7B is a side elevation diagrammatical view illustrating the mounting structure and the convention support surface securely fastened together by the conventional fasteners and the housing body contacting the mounting structure with the U-shaped lever being in the engaged, retracted position and with the fulcrum pin of the mounting structure shown in cross-section.
Figure 7C:
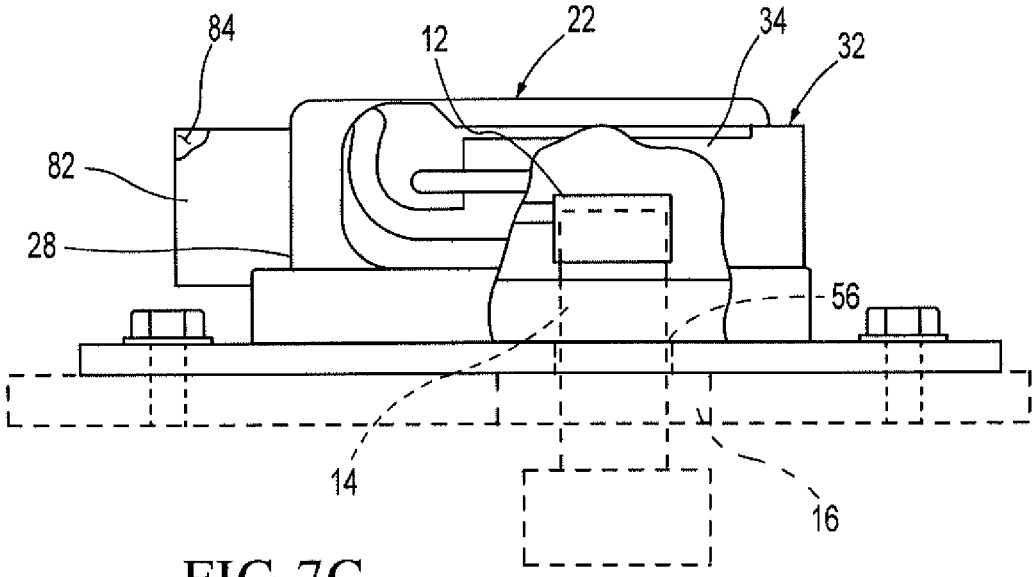
FIG. 7C is a side elevation diagrammatical view illustrating the mounting structure and the convention support surface securely fastened together by the conventional fasteners and the housing body contacting the mounting structure with the U-shaped lever being in the engaged, retracted position with the female electrical terminal being fully drawn downwardly on the male electrical terminal and the housing body being fully drawn downwardly onto the mounting structure.

With reference to FIGS. 1 and 4A-4C, when the electrical connector housing 20 is placed over the mounting structure 52 to cover the at least one mounting plate hole 56, the U-shaped lever 32 is in a pre-engaged position where respective ones of the guide rails 46 are aligned to engage respective ones of the fulcrum parts 58 and the male electrical terminal 14 and the male electrical terminal are aligned to engage with each other and, when the respective ones of the guide rails 46 engage the respective ones of the fulcrum parts 58, the U-shaped lever 32 is operative to angularly move from the pre-engaged position (FIGS. 1 and 4A-4C) to an engaged, extended position (FIGS. 6A-6C). As the U-shaped lever 32 angularly moves from the pre-engaged position (FIGS. 1 and 4A-4C) to the engaged, extended position (FIGS. 6A-6C), the housing body 22 is drawn towards and is connected to the mounting structure 52 and the female electrical terminal 12 is drawn towards and is electrically connected to the male electrical terminal 14. When the U-shaped lever 32 is moved to the engaged, extended position (FIGS. 6A-6C), the slot 44 is oriented parallel to the mounting plate plane MPP and the cross member 36 is disposed apart from the front wall 26 of the housing body 22. Thereafter the U-shaped lever 32 is operative in the engaged, extended position EEP to move rectilinearly to an engaged, retracted position (FIGS. 7A-7C) so that the cross member 36 is disposed adjacent the front wall 26 of the housing body 22, i.e. retracted to the front wall 26. Note that FIGS. 5A-5C illustrate an intermediate position between the pre-engaged position (FIGS. 1 and 4A-4C) and the engaged, extended position (FIGS. 6A-6C) as the U-shaped lever 32 angularly moves therebetween.

In FIG. 8, each one of the pair of lever arms 34 extends in the longitudinal direction LD to include a lever arm connected end portion 60, a lever arm free end portion 62 and a lever arm intermediate portion 64 integrally connected to and disposed between the lever arm connected end portion 60 and the lever arm free end portion 62. The lever arm connected end portion 60 is integrally connected to the cross member 36 and in the lateral direction RD between a first lever arm edge 66 and a second lever arm edge 68 spaced apart from and extending parallel to one another in the longitudinal direction LD. Respective ones of the slots 44 extend longitudinally in the longitudinal direction LD along respective ones of the lever arm intermediate portions 64 and are disposed generally centrally between the first lever arm edge 66 and the second lever arm edge 68 in a widthwise direction defined between the first lever arm edge 66 and the second lever arm edge 68.

Again, with reference to FIG. 8, each one of the lever arm free end portions 62 includes a lever arm free end edge 70. Respective ones of the guide rails 46 extend along respective ones of the first lever arm edge 66 and at least partially along respective ones of the lever arm free end edges 70. Furthermore, each one of the slots 44 has a first slot end 72 and a second slot end 74 disposed opposite the first slot end 72. Additionally, each one of the pair of lever arms 34 includes a plateau 76 that projects from the lever arm outer surface 42, extends around the first slot end 72 and is disposed apart from the guide rail 46 at least at the lever arm free end portion 62 to form a curved channel 78 between the plateau 76 and the guide rail 46 at least at the lever arm free end portion 62.

Also, in FIG. 8, each one of the pair of lever arms 34 includes a bar 80 that projects from the lever arm outer surface 42, is integrally connected to the plateau 76 and extends along the second lever arm edge 68 in order to terminate adjacent the lever arm connected end portion 60. As reflected in FIG. 9, respective ones of the guide rails 46, the plateaus 76 and the bars 80 project equidistantly from the lever arm outer surface 42 at a distance X.

As shown in FIGS. 4A-7C, the housing body 22 includes a pair of hollow tubes 82 that are connected to and extend rearwardly of the rear wall 28 to form a cable-receiving passageway 84 into the housing body 22. The cable-receiving passageway 84 is best shown in FIGS. 4B, 4C, 5B, 5C, 6B, 6C, 7B and 7C.

As is known in the art, the front wall 26 and the rear wall 28 are disposed apart from one another, the pair of side walls 30 are disposed apart from one another and integrally connected to the front wall 26 and the rear wall 28 and the base wall 24 is integrally connect to the front wall 26, the rear wall 28 and the pair of side walls 30 to define a box-shaped cavity 86 shown in FIG. 1 that has an opening 88 thereinto opposite the base wall 24. Again, with reference to FIG. 1, the housing body 22 includes a rear skirt 90 that is integrally connected exteriorly of the housing body 22 adjacent the opening 88 to the rear wall 28 and partially to each one of the pair of side walls 30 to form a rear seal-receiving cavity 92. Also, the housing body 22 includes a front skirt 94 integrally connected exteriorly of the housing body 22 adjacent the opening 88 to the front wall 26 and partially to each one of the pair of side walls 30 to form a front seal-receiving cavity 96. Each one of the rear skirt 90 and the front skirt 94 terminates along respective ones of the pair of side walls 30 to form a pair of gaps 98 (only one gap 98 is shown in FIG. 1) between the rear skirt 90 and the front skirt 94.

As best shown in FIG. 2, the housing body 22 includes a pair of pivot pins 100 (only one pivot pin 100 is shown in FIG. 2). Respective ones of the pair of pivot pins 100 are disposed apart from yet in a vicinity of the gaps 98. Further, respective ones of the pair of pivot pins 100 are integrally connected to respective ones of the pair of side walls 30. Also, respective ones of the slots 44 are sized to receive respective ones of the pivot pins 100 in a close-fitting relationship so that respective ones of the lever arms 34 can slide along and can pivot about the respective ones of the pivot pins 100 as shown in FIGS. 4A-7C.

In FIG. 2, the electrical connector housing 20 includes a seal 102 formed as a continuous loop. By example only, the seal 102 can be a rubber O-ring. The seal 102 is sized to be received in a close-fitting relationship with the rear seal-receiving cavity 92 and the front seal-receiving cavity 96 and extends across respective ones of the gaps 98.

Illustrated in FIGS. 1 and 3, each one of the pair of fulcrum parts 58 includes a post member 104 that extends perpendicularly from the flat mounting plate 54 and a fulcrum pin 106. The fulcrum pin 106 is disposed apart from the flat mounting plate 54 and is connected to and extends perpendicularly from the post member 104. Respective ones of the fulcrum pins 106 face one another along a common fulcrum axis CFA.

Figure 9:
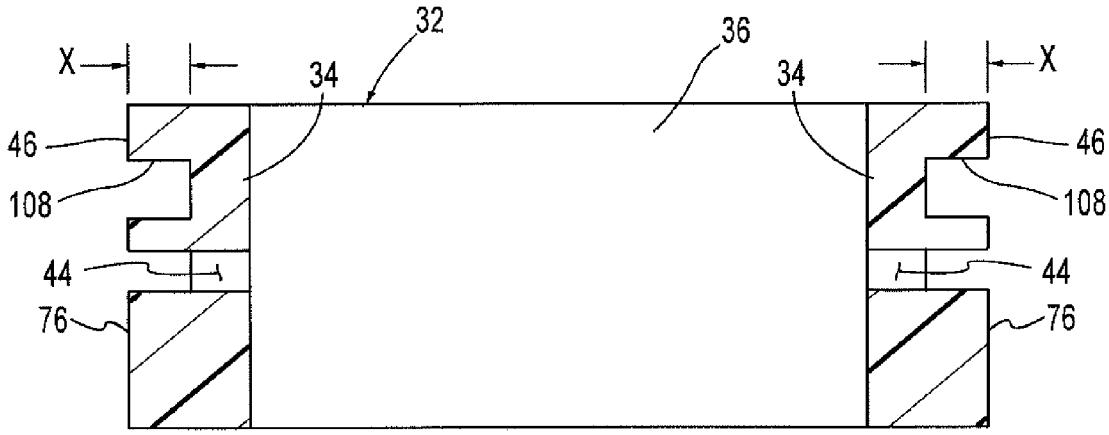
FIG. 9 is a cross-sectional view of the U-shaped lever taken along line 9-9-9 in FIG. 8.
Figure 10:
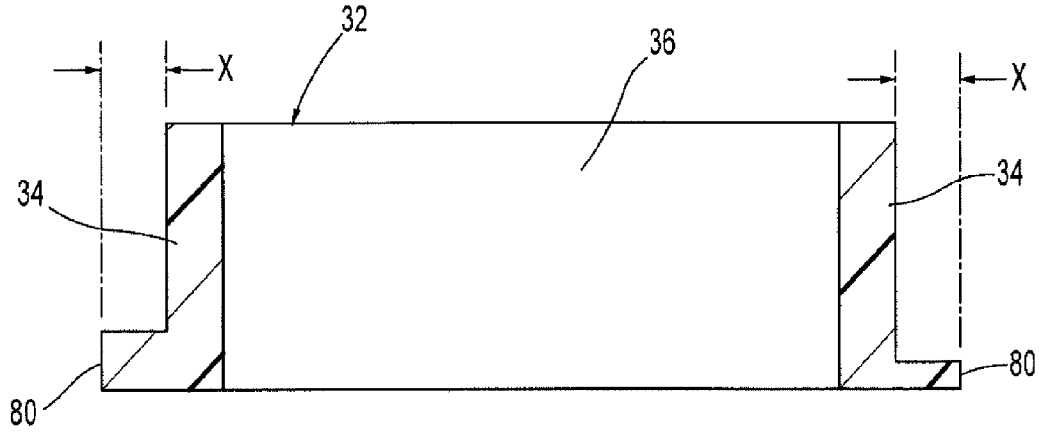
FIG. 10 is a cross-sectional view of the U-shaped lever taken along line 10-10-10 in FIG. 8.

With reference to FIGS. 8 and 9, each one of the guide rails 46 includes an inside guide rail surface 108. The inside guide rail surface 108 extends perpendicularly from the lever arm outer surface 42. And, respective ones of the inside guide rail surface 108 face towards respective ones of the slots 44. As viewed serially in FIGS. 4A through 7C, as the U-shaped lever 32 moves from the pre-engaged position (FIG. 4A-4C) through the engaged, extended position (FIGS. 6*a*-6C) and through the engaged, retracted position (FIGS. 7A-7C), the respective ones of the inside guide rail surfaces 108 contact respective ones of the fulcrum pins 106 in a sliding manner.

Figure 3A:
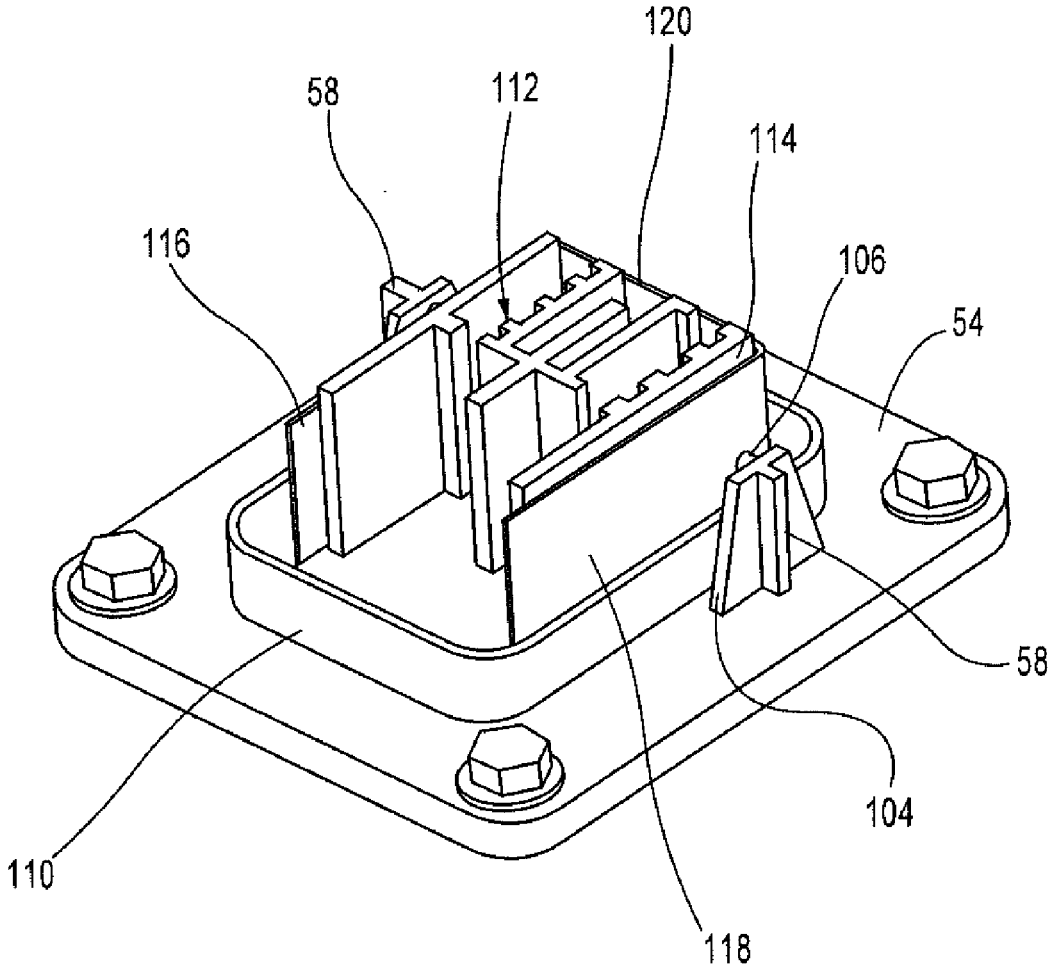
FIG. 3A is a perspective view of the mounting structure illustrated in FIG. 1.
Figure 3B:
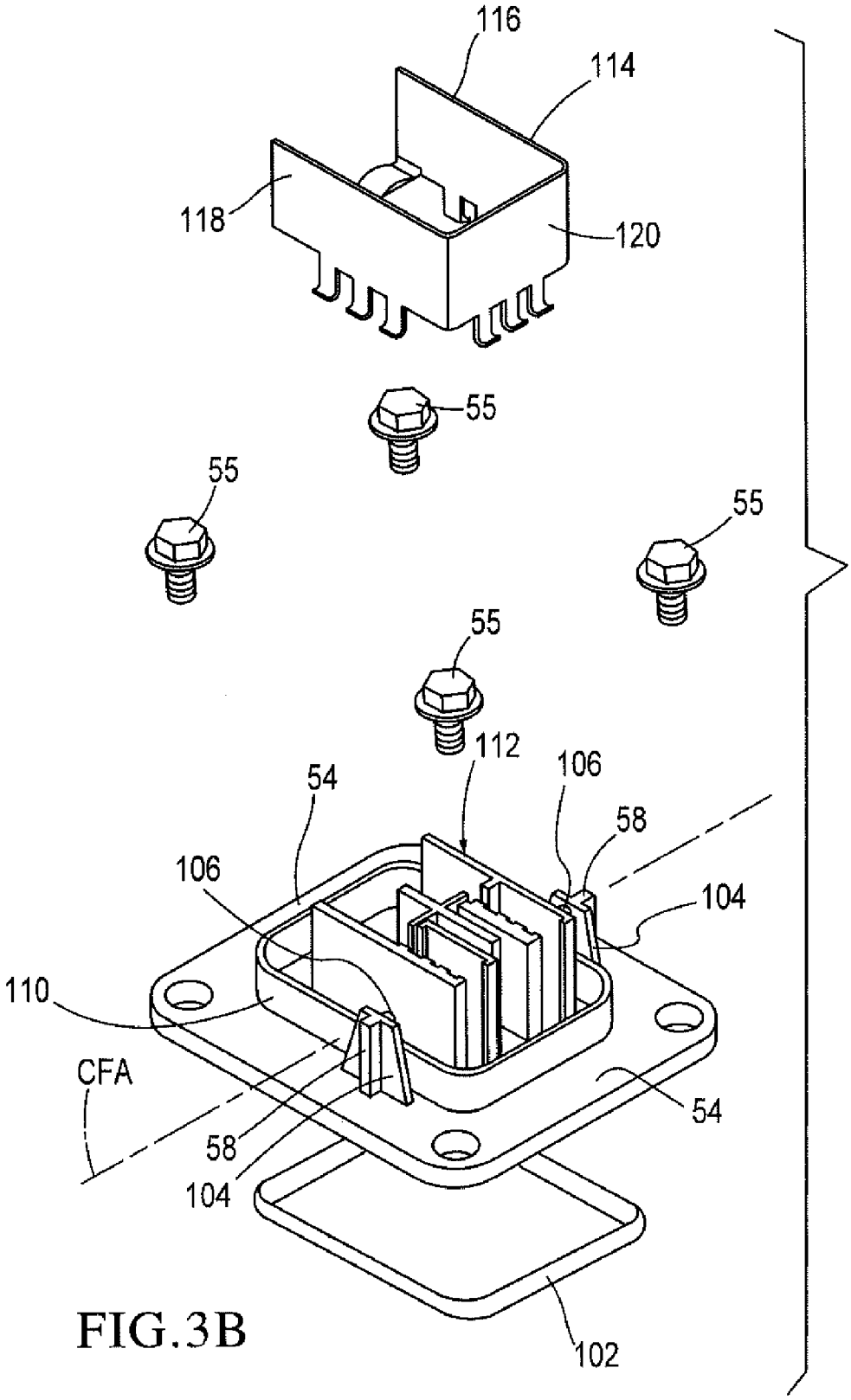
FIG. 3B is an exploded perspective view of the mounting structure illustrated in FIGS. 1 and 3A.
Figure 4A:
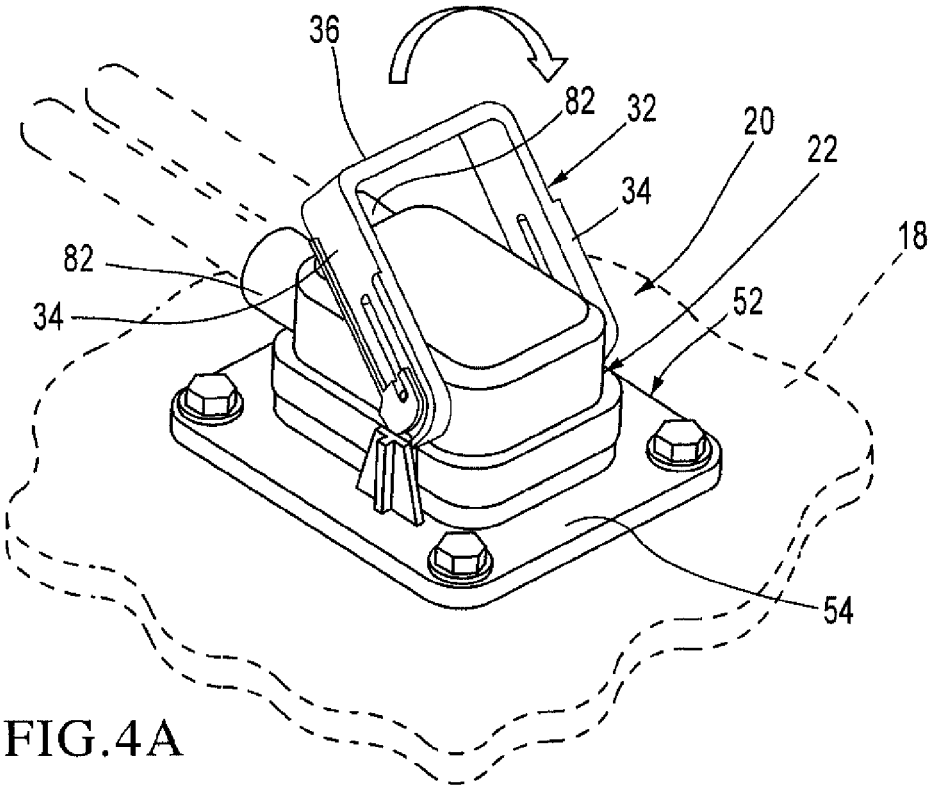
FIG. 4A is a perspective view illustrating the mounting structure and the convention support surface securely fastened together by conventional fasteners and the housing body contacting the mounting structure with the U-shaped lever being in a pre-engaged position.
Figure 4B:
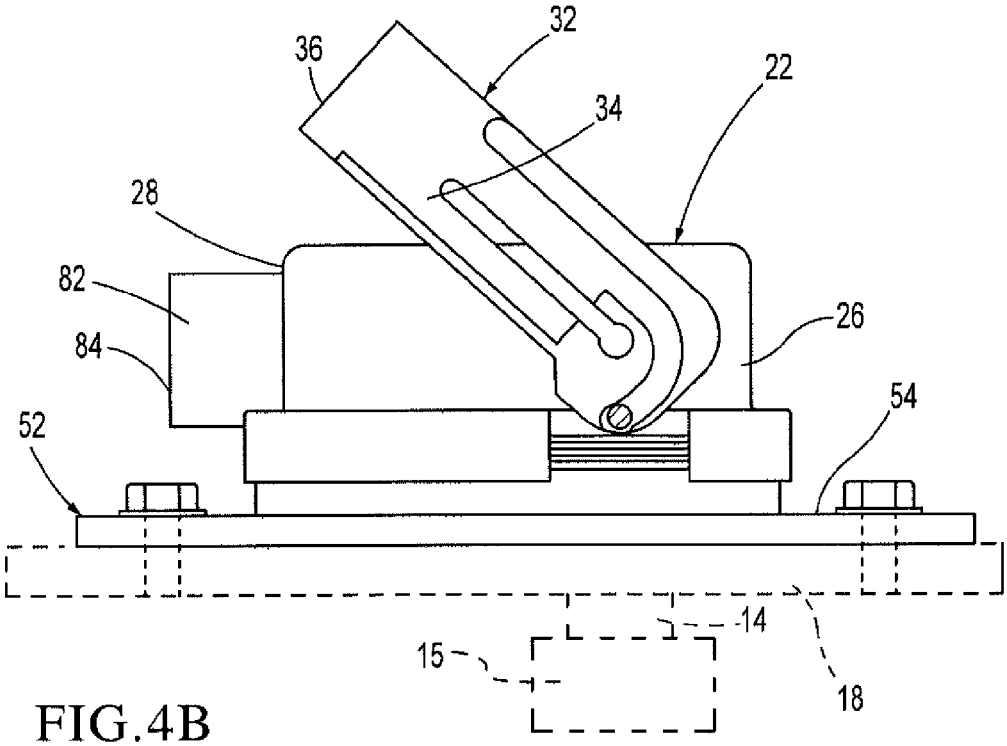
FIG. 4B is a side elevation diagrammatical view illustrating the mounting structure and the convention support surface securely fastened together by the conventional fasteners and the housing body contacting the mounting structure with the U-shaped lever being in the pre-engaged position and with a fulcrum pin of the mounting structure shown in cross-section.
Figure 4C:
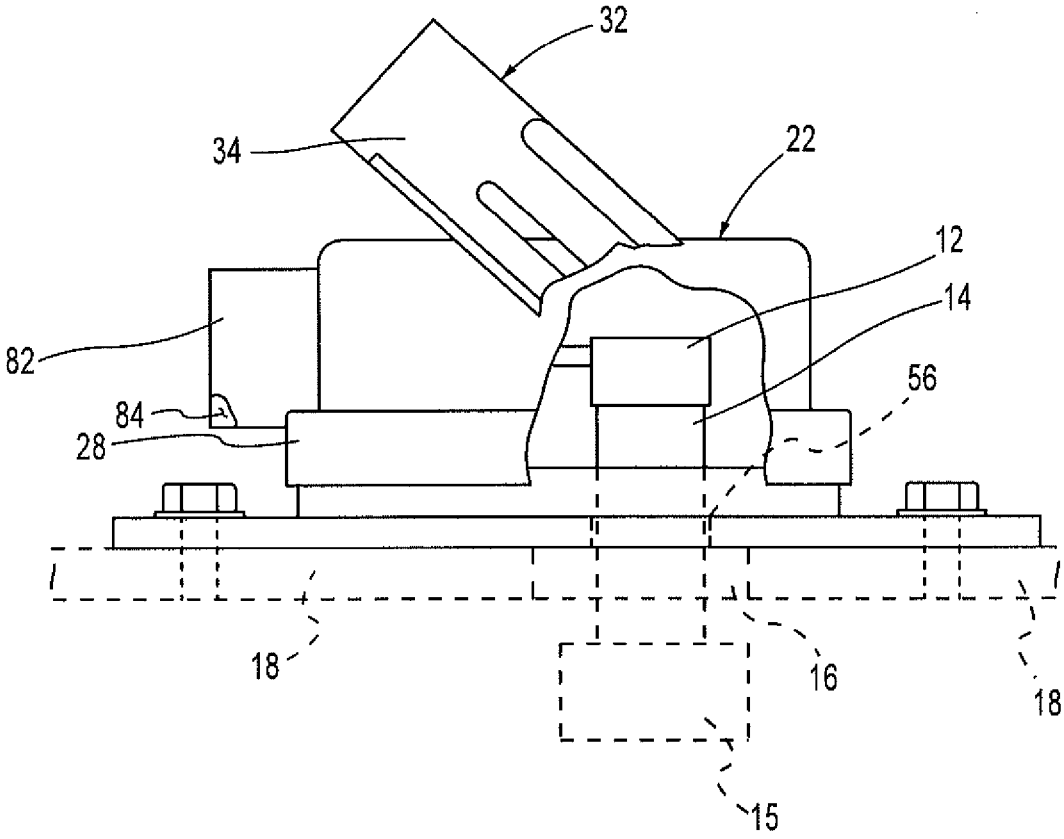
FIG. 4C is a side elevation diagrammatical view illustrating the mounting structure and the convention support surface securely fastened together by the conventional fasteners and the housing body contacting the mounting structure with the U-shaped lever being in the pre-engaged position with a female electrical terminal secured in the housing body aligned with a male electrical terminal projecting into the housing body.

Furthermore, as best illustrated in FIGS. 3A and 3B, the mounting structure 52 includes a mounting plate wall 110 that projects from the flat mounting plate 54. The mounting plate wall 110 forms in an endless loop. Also, the mounting plate wall 110 is positioned interiorly of the pair of fulcrum parts 58 and surrounds the mounting plate holes 56 as shown in FIG. 1. Additionally, in FIGS. 3A and 3B, the mounting structure 52 includes a mounting plate partitioning wall structure 112. The mounting plate partitioning wall structure 112 projects from the flat mounting plate 54 and is positioned interiorly of the mounting plate wall 110.

Again, with reference to FIGS. 3A and 3B, the electrical connector assembly 10 of the present invention includes a mounting plate metal shield 114. The mounting plate metal shield has a first shield wall 116, a second shield wall 118 that extends parallel to the first shield wall 116 and a third shield wall 120 that extends perpendicularly to and interconnects the first shield wall 116 and the second shield wall 118 to form a generally squared U-shape configuration. The mounting plate metal shield 114 extends perpendicularly to the flat mounting plate 54 and is disposed interiorly of the mounting plate wall 110 and exteriorly of the mounting plate partitioning wall structure 112.

With reference to FIG. 2, the electrical connector assembly of the present invention includes a grounding insert 122. The grounding insert 122 is disposed and secured in the box-shaped cavity 86 of the housing body 22. Further, the electrical connector assembly 10 of the present invention includes an inner housing insert 124. The grounding insert 122 is sized and adapted to receive the inner housing insert 124 in the box-shaped cavity 86 of the housing body 22. Moreover, the electrical connector assembly 10 of the present invention includes a yoke assembly 126. Here, the inner housing insert 124 is sized and adapted to receive the yoke assembly 126 in the box-shaped cavity 86 of the housing body 22. The yoke assembly 126 includes a bushing 128, a yoke block 130 and a fastener 132. The fastener 132 is sized and adapted to extend first through the yoke block 130 and then through the bushing 128 in order to secure the cable assemblies 13 in the connector housing 20. The electrical connector assembly 10 of the present invention further includes a terminal position assurance device 134 that is sized to be received by and secured within the inner housing insert 124.

Figure 11:
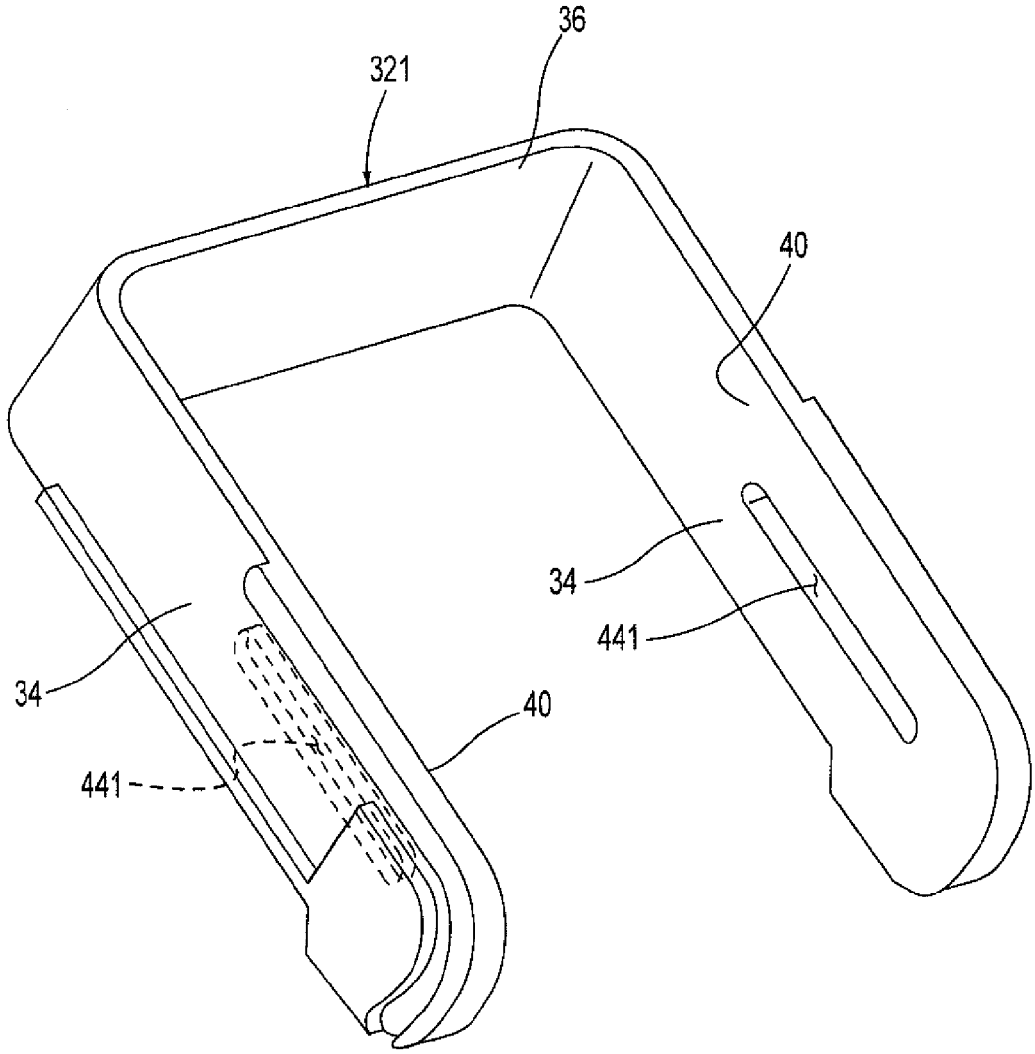
FIG. 11 is a perspective view of an alternative U-shaped lever.

An alternative U-shaped lever 321 is illustrated in FIG. 11. The alternative U-shaped lever 321 is substantially similar to the U-shaped lever 32 described above. The difference is that respective ones of the slots 441 extend only partially into respective ones of the lever arms 34 from the lever arm inner surface 40.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector housing, comprising:

a housing body having a base wall, a front wall, a rear wall, a pair of side walls connected to each other to form a generally box-shaped configuration; and a U-shaped lever pivotably and slidably connected to the housing body on the pair of the side walls, the U-shaped lever having a pair of longitudinally-extending lever arms facially opposing and extending parallel to each other and a cross member interconnecting the pair of lever arms as an integral construction to form a U-shaped channel, each one of the pair of lever arms having a lever arm inner surface facing interiorly into the U-shaped channel and a lever arm outer surface facing exteriorly of the U-shaped channel, each one of the pair of lever arms having a longitudinally-extending slot formed into the lever arm inner surface and a guide rail projecting from the lever arm outer surface, the guide rail having a straight guide rail portion disposed offset from and extending parallel to the slot and an arcuate guide rail portion connected to the straight guide rail portion thereby forming the guide rail into a generally hook-shaped configuration.

2. An electrical connector housing according to claim 1, wherein each one of the pair of lever arms extends in a generally longitudinal lengthwise direction to include a lever arm connected portion, a lever arm free end portion and a lever arm intermediate portion integrally connected to and disposed between the lever arm connected portion and the lever arm free end portion, the lever arm connected end portion integrally connected to the cross member and in a generally transverse widthwise direction between a first lever arm edge and a second lever arm edge spaced apart from and extending parallel to one another in the generally longitudinal lengthwise direction.

3. An electrical connector housing according to claim 2, wherein respective ones of the slots extend in the generally longitudinal lengthwise along respective ones of the lever arm intermediate portions and are disposed generally centrally between the first lever arm edge and the second lever arm edge in the generally transverse widthwise direction defined between the first lever arm edge and the second lever arm edge.

4. An electrical connector housing according to claim 3, wherein each one of the lever arm free end portions includes a lever arm free end edge and respective ones of the guide rails extend along respective ones of the first lever arm edge and at least partially along respective ones of the lever arm free end edges.

5. An electrical connector housing according to claim 4, wherein each one of the slots has a first slot end and a second slot end disposed opposite the first slot end.

6. An electrical connector housing according to claim 5, wherein each one of the pair of lever arms includes a plateau projecting from the lever arm outer surface, extending around the first slot end and disposed apart from the guide rail at least at the lever arm free end portion to form a curved channel between the plateau and the guide rail at least at the lever arm free end portion.

7. An electrical connector housing according to claim 6, wherein each one of the pair of lever arms includes a bar projecting from the lever arm outer surface, integrally connected to the plateau and extending along the second lever arm edge to terminate adjacent the lever arm connected end portion.

8. An electrical connector housing according to claim 7, wherein respective ones of the guide rails, the plateaus and the bars project equidistantly from the lever arm outer surface.

9. An electrical connector housing according to claim 1, wherein the housing body includes at least one hollow tube connected to and extending rearwardly of the rear wall forming a cable-receiving passageway into the housing body.

10. An electrical connector housing according to claim 1, wherein the front wall and the rear wall are disposed apart from one another, the pair of side walls are disposed apart from one another and integrally connected to the front wall and the rear wall and the base wall is integrally connect to the front wall, the rear wall and the pair of side walls to define a box-shaped cavity having an opening thereinto opposite the base wall and wherein the housing body includes a rear skirt integrally connected exteriorly of the housing body adjacent the opening to the rear wall and partially to each one of the pair of side walls to form a rear seal-receiving cavity and a front skirt integrally connected exteriorly of the housing body adjacent the opening to the front wall and partially to each one of the pair of side walls to form a front seal-receiving cavity, each one of the rear skirt and the front skirt terminates along respective ones of the pair of side walls to form a pair of gaps between the rear skirt and the front skirt.

11. An electrical connector housing according to claim 10, wherein the housing body includes a pair of pivot pins, respective ones of the pair of pivot pins disposed apart from yet in a vicinity of the gaps, respective ones of the pair of pivot pins integrally connected to respective ones of the pair of side walls, respective ones of the slots sized to receive respective ones of the pivot pins in a close-fitting relationship so that respective ones of the lever arms slide along and pivot about the respective ones of the pivot pins.

12. An electrical connector housing according to claim 10, further comprising a seal formed as a continuous loop and sized to be received in a close-fitting relationship with the rear seal-receiving cavity and the front seal-receiving cavity and extending, in part, across respective ones of the gaps.

13. An electrical connector housing according to claim 1, wherein respective ones of the slots extend either partially into respective ones of the lever arms from the lever arm inner surface or completely through respective ones of the lever arms between the lever arm inner surface and the lever arm outer surface.

14. An electrical connector assembly, comprising:

an electrical connector housing including:

a housing body having a base wall, a front wall, a rear wall, a pair of side walls connected to each other to form a generally box-shaped configuration; and a U-shaped lever pivotably and slidably connected to the housing body on the pair of the side walls, the U-shaped lever having a pair of longitudinally-extending lever arms facially opposing and extending parallel to each other and a cross member interconnecting the pair of lever arms as an integral construction to form a U-shaped channel, each one of the pair of lever arms having a lever arm inner surface facing interiorly into the U-shaped channel and a lever arm outer surface facing exteriorly of the U-shaped channel, each one of the pair of lever arms having a longitudinally-extending slot formed into the lever arm inner surface and a guide rail projecting from the lever arm outer surface, the guide rail having a straight guide rail portion disposed offset from and extending parallel to the slot and an arcuate guide rail portion connected to the straight guide rail portion thereby forming the guide rail into a generally hook-shaped configuration; and a mounting structure including a flat mounting plate defining a mounting plate plane and formed with at least one mounting plate hole extending through the flat mounting plate and a pair of fulcrum parts connected to and projecting from the flat mounting plate, disposed apart from one another and straddling the at least one mounting plate hole, wherein, when the electrical connector housing is placed over the mounting structure to cover the at least one mounting plate hole, the U-shaped lever is in a pre-engaged position where respective ones of the guide rails are aligned to engage respective ones of the fulcrum parts and, when the respective ones of the guide rails engage the respective ones of the fulcrum parts, the U-shaped lever is operative to angularly move from the pre-engaged position to an engaged, extended position where the housing body is fully drawn towards and connected to the mounting structure and the slot is oriented parallel to the mounting plate plane with the cross member being disposed apart from the front wall of the housing body and the U-shaped lever is operative in the engaged, extended position to move rectilinearly to an engaged, retracted position so that the cross member is disposed adjacent the front wall of the housing body.

15. An electrical connector assembly according to claim 14, wherein each one of the pair of fulcrum parts includes a post member extending perpendicularly from the flat mounting plate and a fulcrum pin disposed apart from the flat mounting plate and connected to and extending perpendicularly from the post member, respective ones of the fulcrum pins face one another along a common fulcrum pin axis.

16. An electrical connector assembly according to claim 15, wherein each one of the guide rails includes an inside guide rail surface extending perpendicularly from the lever arm outer surface, respective ones of the inside guide rail surface face towards respective ones of the slots.

17. An electrical connector assembly according to claim 16, wherein, as the U-shaped lever moves from the pre-engaged position through the engaged, extended position and to the engaged, retracted position, the respective ones of the inside guide rail surfaces contact respective ones of the fulcrum pins in a sliding manner.

18. An electrical connector assembly according to claim 14, wherein the mounting structure includes a mounting plate wall projecting from the flat mounting plate and formed in an endless loop, the mounting plate wall positioned interiorly of the pair of fulcrum parts and surrounding the at least one mounting plate hole.

19. An electrical connector assembly according to claim 18, wherein the mounting structure includes a mounting plate partitioning wall structure projecting from the flat mounting plate and positioned interiorly of the mounting plate wall.

20. An electrical connector assembly according to claim 18, further comprising a mounting plate metal shield having a first shield wall, a second shield wall extending parallel to the first shield wall and a third shield wall extending perpendicularly to and interconnecting the first shield wall and the second shield wall to form a generally squared U-shape configuration, the mounting plate metal shield extending perpendicularly to the flat mounting plate and being disposed interiorly of the mounting plate wall and exteriorly of the mounting plate partitioning wall structure.

21. An electrical connector assembly according to claim 14, further comprising a grounding insert disposed and secured in the box-shaped cavity of the housing body.

22. An electrical connector assembly according to claim 21, further comprising an inner housing insert and wherein the grounding insert is sized and adapted to receive the inner housing insert in the box-shaped cavity of the housing body.

23. An electrical connector assembly according to claim 22, further comprising a yoke assembly and wherein the inner housing insert is sized and adapted to receive the yoke assembly in the box-shaped cavity of the housing body.

24. An electrical connector assembly according to claim 14, wherein the yoke assembly includes a bushing, a yoke block and a fastener sized and adapted to extend first through the yoke block and then through the bushing.

25. An electrical connector assembly according to claim 23, further comprising a terminal position assurance device sized to be received by and secured within the inner housing insert.

26. An electrical connector assembly for connecting a female electrical terminal to a male electrical terminal, the male electrical terminal extending through a support surface hole of a support surface and secured therein in a stationary manner, the electrical connector assembly comprising:

an electrical connector housing including:

a housing body having a base wall, a front wall, a rear wall, a pair of side walls connected to each other to form a generally box-shaped configuration; and a U-shaped lever pivotably and slidably connected to the housing body on the pair of the side walls, the U-shaped lever having a pair of longitudinally-extending lever arms facially opposing and extending parallel to each other and a cross member interconnecting the pair of lever arms as an integral construction to form a U-shaped channel, each one of the pair of lever arms having a lever arm inner surface facing interiorly into the U-shaped channel and a lever arm outer surface facing exteriorly of the U-shaped channel, each one of the pair of lever arms having a longitudinally-extending slot formed into the lever arm inner surface and a guide rail projecting from the lever arm outer surface, the guide rail having a straight guide rail portion disposed offset from and extending parallel to the slot and an arcuate guide rail portion connected to the straight guide rail portion thereby forming the guide rail into a generally hook-shaped configuration; and a mounting structure including a flat mounting plate defining a mounting plate plane and formed with at least one mounting plate hole extending through the flat mounting plate and a pair of fulcrum parts connected to and projecting from the flat mounting plate, disposed apart from one another and straddling the at least one mounting plate hole, the mounting structure fastened to the support surface in a manner that the at least one mounting plate hole and the support surface hole facially oppose and communicate with each other;

wherein the housing body retains the female electrical terminal therein and the male electrical terminal projects through the support surface hole and the at least one mounting plate hole at a distance in order to be received by and connect to the female electrical terminal and wherein, when the electrical connector housing is placed over the mounting structure to cover the at least one mounting plate hole, the U-shaped lever is in a pre-engaged position where respective ones of the guide rails are aligned to engage respective ones of the fulcrum parts and the female electrical terminal and the male electrical terminal are aligned to engage with each other and, when the respective ones of the guide rails engage the respective ones of the fulcrum parts, the U-shaped lever is operative to angularly move from the pre-engaged position to an engaged, extended position where the housing body is drawn towards and connected to the mounting structure, the female electrical terminal is drawn towards and electrically connected to the male electrical terminal and the slot is oriented parallel to the mounting plate plane with the cross member being disposed apart from the front wall of the housing body and the U-shaped lever is operative in the engaged, extended position to move rectilinearly to an engaged, retracted position so that the cross member is disposed adjacent the front wall of the housing body.

* * * * *